US008776486B2

(12) United States Patent
Michels et al.

(10) Patent No.: US 8,776,486 B2
(45) Date of Patent: Jul. 15, 2014

(54) APPARATUS FOR WRAPPING A STACK OF OBJECTS WITH A FILM

(75) Inventors: Frank Rolf Michels, Kleve (DE); Norbert Vermeulen, Kleve-Warbeyen (DE)

(73) Assignee: MSK-Verpackungs-Systeme GmbH, Kleve (DE)

( * ) Notice: Subject to any disclaimer, the term of this patent is extended or adjusted under 35 U.S.C. 154(b) by 468 days.

(21) Appl. No.: 13/015,719

(22) Filed: Jan. 28, 2011

(65) Prior Publication Data

US 2011/0185687 A1 Aug. 4, 2011

(30) Foreign Application Priority Data

Jan. 29, 2010 (DE) ..... 20 2010 001 587 U

(51) Int. Cl.
*B65B 11/48* (2006.01)

(52) U.S. Cl.
USPC ..... 53/582; 53/399; 53/580

(58) Field of Classification Search
USPC ..... 53/397, 399, 441, 445, 450, 564, 567, 53/584–585, 587–592, 580
See application file for complete search history.

(56) References Cited

U.S. PATENT DOCUMENTS

| | | | | | |
|---|---|---|---|---|---|
| 3,715,861 | A * | 2/1973 | Odelberg | 53/211 |
| 3,858,380 | A * | 1/1975 | Schmechel | 53/52 |
| 3,897,671 | A * | 8/1975 | Higgins | 53/442 |
| 4,575,989 | A * | 3/1986 | Hannen | 53/434 |
| 4,632,321 | A * | 12/1986 | Danler | 241/62 |
| 4,651,508 | A * | 3/1987 | Hannen | 53/557 |
| 4,724,658 | A * | 2/1988 | Birkenfeld et al. | 53/557 |
| 4,938,903 | A * | 7/1990 | Schaeffer et al. | 264/565 |
| 5,042,235 | A * | 8/1991 | Hannen et al. | 53/557 |
| 5,086,607 | A * | 2/1992 | Ozeki | 53/64 |
| 5,156,312 | A * | 10/1992 | Kurie | 242/615.11 |
| 5,179,815 | A * | 1/1993 | Cahill et al. | 53/133.3 |
| 6,298,636 | B1 * | 10/2001 | Lachenmeier et al. | 53/442 |
| 7,481,033 | B2 * | 1/2009 | Ouellette et al. | 53/553 |
| 8,191,337 | B2 * | 6/2012 | Moore | 53/210 |
| 2001/0047640 | A1 * | 12/2001 | Schaefer | 53/399 |
| 2002/0190142 | A1 * | 12/2002 | Chen et al. | 239/567 |
| 2009/0019817 | A1 * | 1/2009 | Selle et al. | 53/399 |
| 2012/0325400 | A1 * | 12/2012 | Brandes | 156/230 |

* cited by examiner

*Primary Examiner* — Christopher Harmon
(74) *Attorney, Agent, or Firm* — Andrew Wilford

(57) ABSTRACT

An apparatus for wrapping an object with a film has a film-feed head having a drive for pulling the film from a supply and feeding it in a feed direction through the head toward an object to be wrapped with the film and a pull-down device downstream in the direction from the head for drawing the film around the object. A blower directs a stream of air in the feed head parallel and immediately adjacent to the film and in the feed direction so as to entrain the film in the direction.

16 Claims, 3 Drawing Sheets

APPARATUS FOR WRAPPING A STACK OF OBJECTS WITH A FILM

FIELD OF THE INVENTION

The present invention relates to a packaging machine. More particularly this invention concerns an apparatus for wrapping an object or stack of objects with a film.

BACKGROUND OF THE INVENTION

A standard apparatus for wrapping a stack of goods with a film has at least one film supply, one film-feed head and one pull-down device for drawing the film over the stack of goods, the film being fed from the film supply to the film-feed head. In the context of the invention, the film is a plastic film. The stack of goods can consist, on the one hand, of goods such as, for example boxes or the like. On the other, the stack of goods can also involve products from the field of white goods such as, for example a refrigerator. Normally the stack of goods is sitting on a pallet.

From practice, apparatuses of the above-described type are known in different embodiments. Usually, an initially closed tubular film is transferred from the film supply to the film-feed head where a tubular film section necessary for the draw-down process is detached by a separator. Often, the film-feed head comprises also a welder that welds closed the tubular film section at its upper end to form a film hood. During transport, the tubular film has the tendency to get electrostatically charged. The results is that the tubular film or that the one or other layer of the tubular film clings in particular to metallic parts of the film-feed head. The tubular film can get caught at these points and an undesired film jam occurs that often requires manual clearing by an operator. When the tubular film is guided through a gap formed by guide walls and tapered in the feed direction, the tubular film or the layers of the tubular film can particularly easily get caught on the guide walls. This can result in a premature, unintended and disadvantageous opening of the tubular film. This makes it particularly easy for the tubular film, which is already slightly opened in this manner, to cling to downstream parts. The film can in particular rest against the welder downstream in the feed direction and can then get jammed back in a disadvantageous manner into the guide gap. This requires complicated interventions.

OBJECTS OF THE INVENTION

It is therefore an object of the present invention to provide an improved apparatus for wrapping a stack of objects with a film.

Another object is the provision of such an improved apparatus for wrapping a stack of objects with a film that overcomes the above-given disadvantages, in particular in which the disadvantages described above can be prevented.

SUMMARY OF THE INVENTION

An apparatus for wrapping an object with a film has according to the invention a film-feed head having a drive for pulling the film from a supply and feeding it in a feed direction through the head toward an object to be wrapped with the film and a pull-down device downstream in the direction from the head for drawing the film around the object. A blower directs a stream of air in the feed head parallel and immediately adjacent to the film and in the feed direction so as to entrain the film in the direction.

The feed direction here is the direction in which the film is fed through the feed head and preferably also downstream of or below the film-feed head. According to a preferred embodiment of the invention, the term air under pressure means air under superatmospheric pressure. According to another embodiment of the invention, the term air under pressure also represents any other gas that can be pressurized.

It lies within the scope of the invention that the film can be fed from the film supply to the film-feed head as a tubular film or as a closed tubular film. Such a closed tubular film has two film layers lying against of each other. According to a preferred embodiment of the invention, the tubular film is formed as a side-fold tubular film. In this case, in addition to the two mentioned film layers lying against each other, advantageously and in a manner known per se, the tubular film has one inset fold on each side. It lies within the scope of the invention that the tubular film is fed as a closed tubular film through the film-feed head. Preferably, the initially closed tubular film is opened in the feed direction downstream of or below the film-feed head with an opener for the draw-down process. The film supply is advantageously formed as a tubular film reel or tubular film roll.

A particularly preferred embodiment of the invention is characterized in that the film drive has at least one guide roller and at least one pair of counter rollers and that during feeding the film or the tubular film, the two counter rollers press the film or the tubular film against the guide roller. For feeding the film, the guide roller and/or at least one counter roller is driven. Preferably, only the guide roller is driven and the two counter rollers are not driven. According to an embodiment variant, the film-feed head is configured for feeding a first film or a second film. In this case, the film-feed head comprises a guide roller, a first pair of counter rollers and a second pair of counter rollers. In this embodiment variant, the first pair of counter rollers can be brought in to pinch the first film against the guide roller and the guide roller is driven for feeding the first film. Alternatively, the second pair of counter rollers can be brought in to pinch the second film against the guide roller and the guide roller is driven for feeding the second film.

It lies within the scope of the invention that the film-feed head has at least two guide walls, preferably two guide walls that form for the film or the tubular film a guide gap that tapers in the feed direction. Advantageously, the guide walls are formed as guide plates. It is recommended that the guide walls form an angle $\alpha$ of 20° to 45°, preferred of 25° to 40°. Preferably, the guide gap formed by the guide walls is downstream in the feed direction of the film or below the film drive.

According to a preferred embodiment of the invention, the guide walls forming the guide gap extend over at least 80%, preferably over at least 90% of the width of the fed film or the fed tubular film. According to the recommended embodiment variant, the guide walls extend at least over the entire width of the fed film or the fed tubular film. According to a particularly preferred embodiment of the invention, the width of the guide walls exceeds the width of the fed film or the fed tubular film. Preferably, the guide walls project beyond both edges of the film or the tubular film. Width means here the extension of the film/the tubular film or the guide walls transverse or perpendicular to the feed direction.

It is recommended that the stream of air under pressure is blown in with the blower in the direction or substantially in the direction in which the film is guided and is blown along at least one of the two guide walls, preferably along the two guide walls. It lies within the scope of the invention that the stream of air under pressure is blown in directly along the face of a guide wall. Advantageously, the stream of air under pressure is blown in parallel to a guide wall or at an acute angle to the guide wall. It is recommended to blow in the stream of air under pressure along the outer face of at least one guide wall, preferably along the outer faces of both guide walls. Outer face of a guide wall means here the guide-wall face directed away from the guide gap. According to another embodiment of the invention, the stream of air under pressure is blown in along the inner face of at least one guide wall; preferably along the inner faces of both guide walls.

It lies further within the scope of the invention that air under pressure is blown in over at least 60%, preferred over at least 75% and very preferred over at least 90% of the width of the film or the tubular film. Preferably, the stream of air under pressure is blown in at least over the entire width of the film or the tubular film. According to a preferred embodiment, the injection of air under pressure is carried out beyond the width of the film or the tubular film and preferably beyond the width of the film or the tubular film on both faces of the film or the tubular film. The injection of air under pressure can take place via at least one air under pressure slot or via a plurality of distributed pressurized-air openings.

According to a proven embodiment of the invention, the blower has at least one blow pipe and a plurality of blow openings is distributed along the length of the blow pipe. A blow pipe unit can be a single blow pipe or a plurality of blow pipes arranged one behind the other. It is recommended that the blow openings of a blow pipe be uniformly spaced from one another. According to a particularly preferred embodiment of the invention, at least one blow pipe extends along at least one guide wall. The blow pipe extends preferably parallel to the guide wall and transverse to the feed direction of the film. According to a particularly recommended embodiment of the invention, a respective blow pipe extends along each of the two guide walls. Each blow pipe preferably has a plurality of blow openings that are distributed over the length of the blow pipe. It is recommended that a blow pipe or a blow pipe extends over at least 60%, preferred over at least 75%, and particularly preferred over at least 90% of the width of a guide wall or the width of the fed film. It is recommended that a blow pipe or a blow pipe extends over at least the entire width of a guide wall or over at least the entire width of the fed film. According to a particularly preferred embodiment, a blow pipe or a blow pipe is longer than the width of the associated guide wall or the width of the fed film, namely preferably on both faces of the guide wall or the film. Width means the extension of the guide wall or the film transverse to the feed direction of the film. Advantageously, a blow pipe is arranged at only a short spacing from the respective guide wall.

It lies within the scope of the invention that the stream of air under pressure can be blown in such that the stream of air under pressure first moves in laminar flow along at least one guide wall and subsequently in laminar flow along the surface of the film or the tubular film. It is particularly preferred here that the stream of air under pressure first flows in laminar flow along the surfaces of the outer faces of both guide walls and subsequently flows along the surfaces of the opposing layers of the tubular film. It lies within the scope of the invention that the stream of air under pressure flows directly over the surfaces of the guide walls and the film or the tubular film.

It is recommended that the film-feed head has a separator for detaching film sections or tubular film sections. Advantageously, the separator is configured as a cutter for cutting off film sections or tubular film sections.

According to a recommended embodiment of the invention, the guide walls forming the guide gap are between the film drive and the separator. Preferably the blower is between the film drive and the separator. According to one embodiment, furthermore, the film-feed head has a welder. The welder comprises preferably two welding bars, at least one of which can be moved against the other welding bar. It is recommended that in feed direction downstream of or below the film-feed head, an opener for opening the tubular film is arranged for a draw-down process.

The invention is based on the knowledge that with the apparatus according to the invention, the disadvantages described above with respect to the prior art can be prevented in a simple and effective manner. Due to the pressurized-air injection according to the invention, the film or tubular film guided through the film-feed head is stabilized at the same time so that the film or tubular film can virtually be guided in an exact manner in the feed direction without the tubular film or the layers of the tubular film clinging in an undesired manner against parts of the film-feed head. Undesired sticking of the film or the tubular film in the film-feed head and undesired film jams can be effectively prevented with the measures according to the invention or can at least be minimized. The apparatus according to the invention is structured in a relatively simple manner and the parts according to the invention can also be retrofitted in a simple manner in an already existing apparatus.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
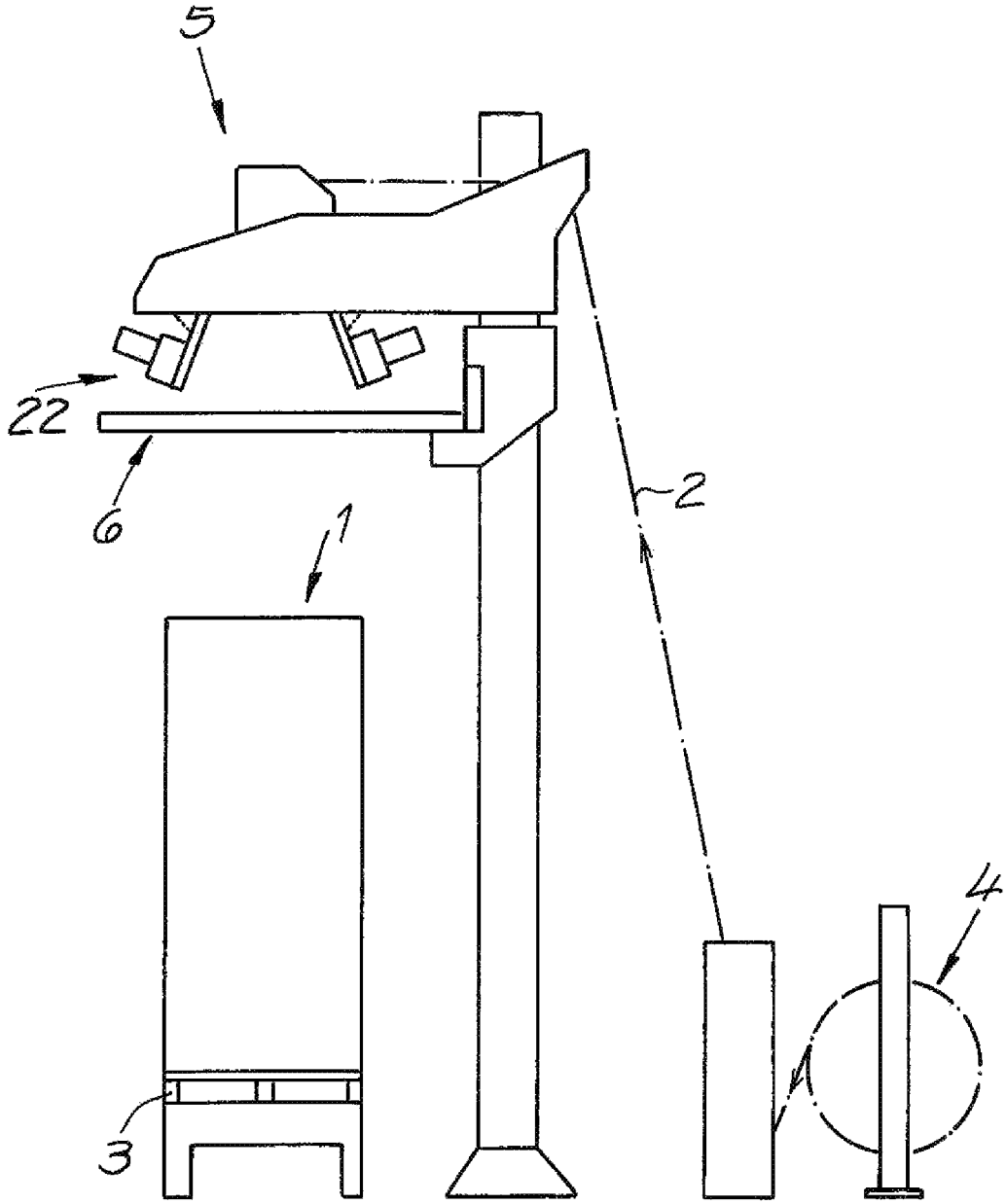
FIG. 1 is a side view of an apparatus according to the invention.

FIG. 1 show an apparatus for wrapping a stack 1 of goods with a tubular film 2. In the illustrated embodiment, the stack of goods is carried on a pallet 3. The apparatus has a film supply 4 in the form of a tubular roll of film and a film-feed head 5 for feeding the tubular film 2. Furthermore, the apparatus is equipped with a pull-down device 6 for drawing the tubular film 2 or for drawing a tubular film section down over the stack 1 of goods.

Figure 2:
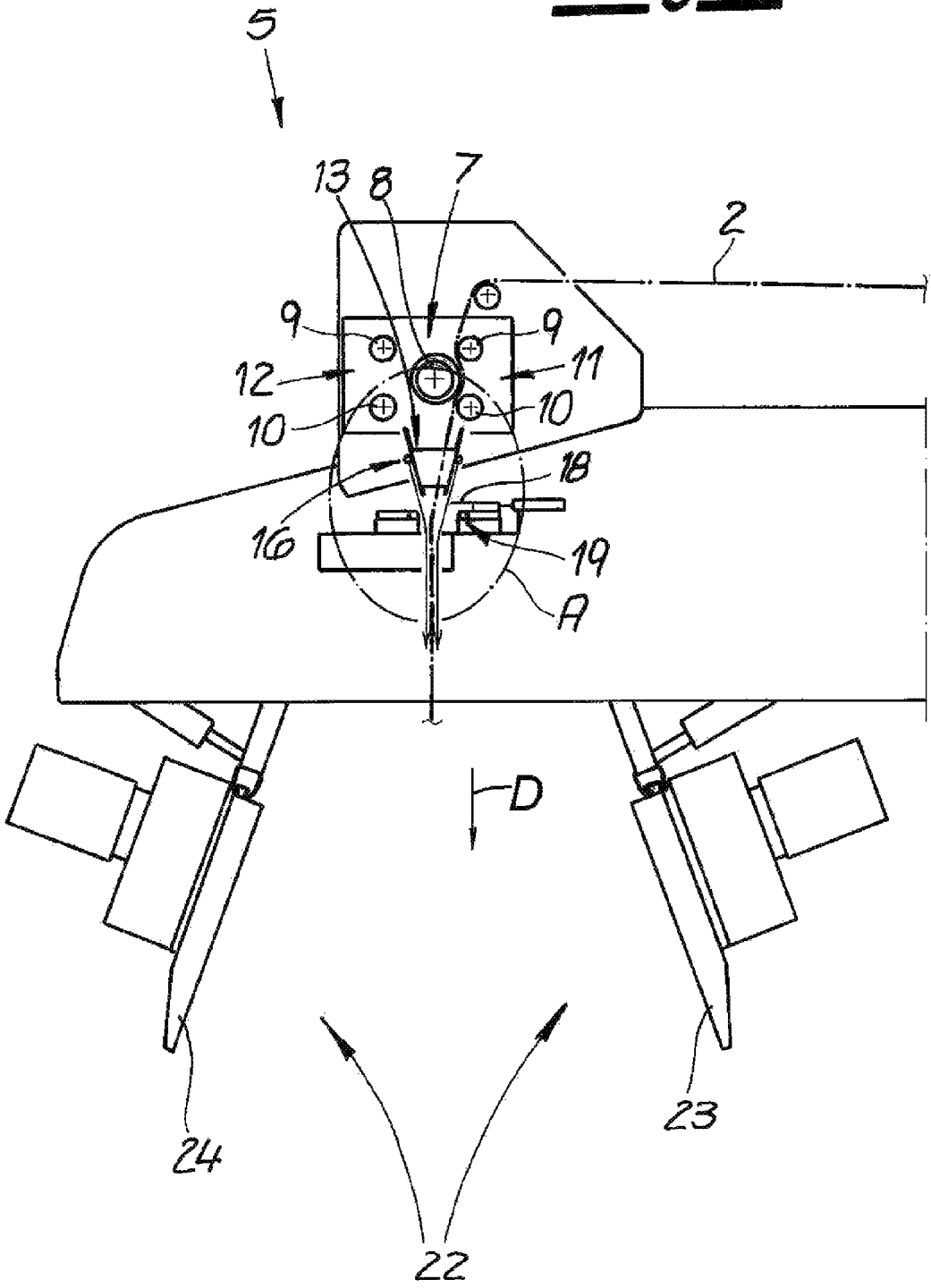
FIG. 2 is a larger-scale section through the film-feed head of the apparatus according to the invention.

In FIG. 2, the film-feed head 5 is illustrated in detail. The film-feed head 5 is equipped with a film drive 7 for feeding the tubular film 2. In the illustrated embodiment, the film drive 7 has a driven guide roller 8 and two pairs 11 and 12 of counter rollers 9 and 10. Optionally, either the first pair 11 of counter rollers 9 and 10 can be pinch a first tubular film 2 against the guide roller 8, or the second pair 12 of counter rollers 9 and 10 can pinch a non-illustrated second tubular film against the guide roller. For feeding the first tubular film 2 or the second tubular film, the guide roller 8 is therefore driven. Advantageously and in the illustrated embodiment, the counter rollers 9 and 10 are not driven and a drive motor 25 rotates the roller 8 continuously.

The tubular film 2 fed by the film drive 7 is then guided through a gap 13 that tapers in a feed direction D and that is formed by two walls 14 and 15 preferably formed as guide plates. Advantageously, the guide walls 14 and 15 extend over the entire width of the fed tubular film 2.

According to the invention, the film-feed head has a blower 16 that directs a stream of air under pressure at the tubular film 2 such that it is guided and/or entrained in the feed direction D by the air under pressure. Preferably and in the illustrated embodiment, the stream of air under pressure is blown in with the blower 16 in the direction D in which the tubular film 2 is guided through the guide gap 13 and moves along the outer faces of the two guide walls 14 and 15. The stream of pressurized-air is advantageously blown in at least over the entire width of the tubular film 2.

Figure 3:
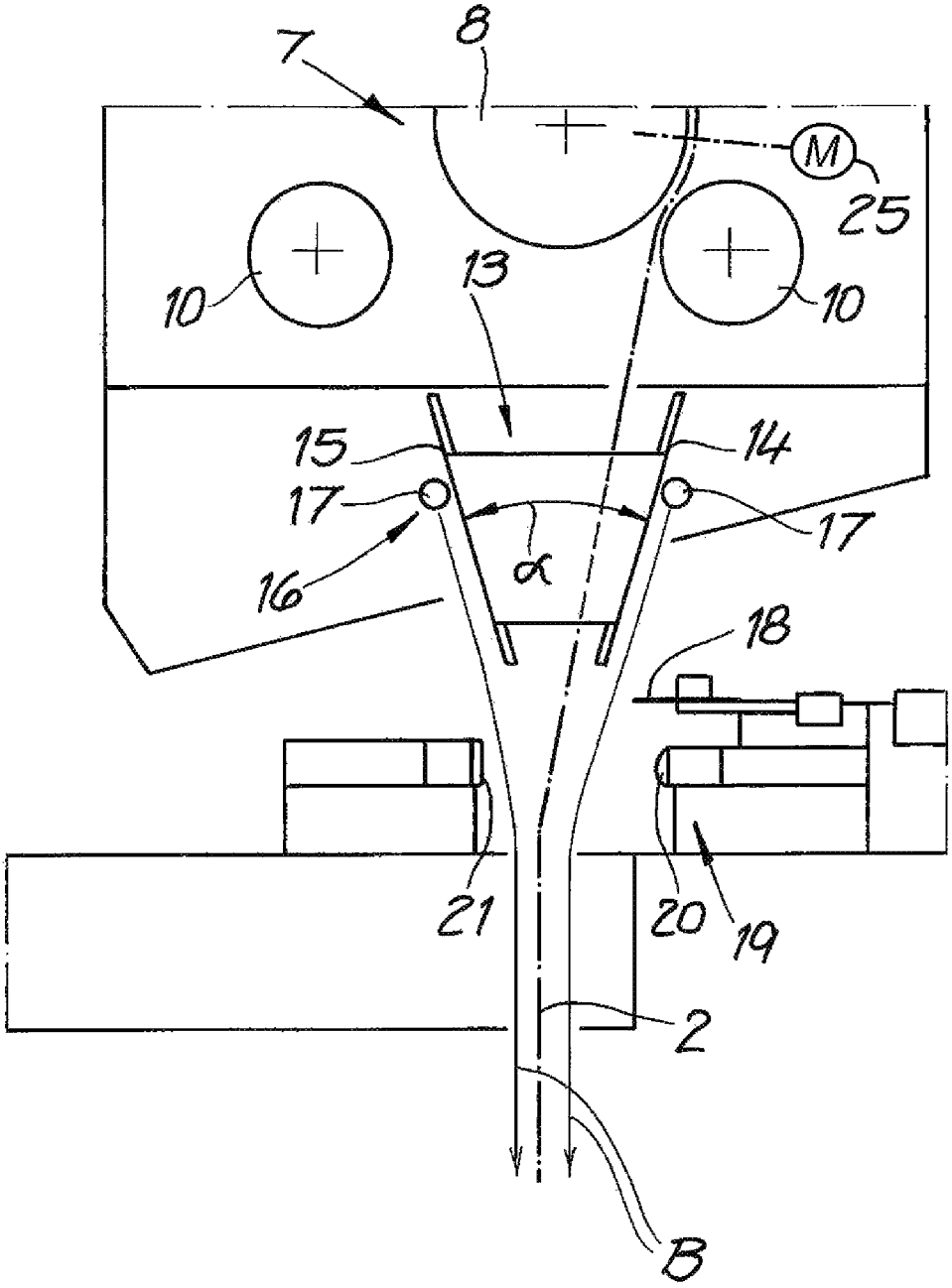
FIG. 3 is a large-scale view of the detail shown at A in FIG. 2.

Preferably and in the illustrated embodiment, the blower 16 has two blow pipes 17. Preferably each blow pipe 17, with respect to the height of the guide walls 14, 15, is in the region of the upper half of the respective guide wall 14 or 15. A blow pipe 17 can be a single blow pipe or a plurality of blow pipes extending transverse to the feed direction D and one behind the other. Advantageously, a plurality of blow openings is arranged in a manner not illustrated here along the length of each blow pipe. Preferably, the blow openings are oriented such that the air under pressure exits therefrom at an angle corresponding to that of the guide walls 14 and 15. The two blow pipes 17 preferably extend over the entire width of the guide walls 14 and 15 or the entire width of the tubular film 2. FIGS. 2 and 3 show that the blow pipes 17 are set at a short spacing outward from the guide walls 14 and 15. It is recommended that the air under pressure is blown in with the blower 16 or the blow pipes 17 such that the stream of air under pressure flows first directly or in laminar flow along the two guide walls 13 and 14 and subsequently flows directly or in laminar flow along the surfaces of the two layers of the tubular film 2. Preferably, the stream of air under pressure flows first parallel to the two guide walls 14 and 15 along the outer faces of the guide walls 14 and 15 and then parallel to the tubular film 2 along the two outer faces of the closed tubular film 2. This flow of air under pressure is indicated in FIGS. 2 and 3 by an arrow B.

Advantageously and in the illustrated embodiment, the film-feed head 5 has a separator 18 configured as a cutter for detaching tubular film sections. FIGS. 2 and 3 show that according to a preferred embodiment, the guide walls 14 and 15 forming the guide gap 13 are between the film drive 7 and the cutter 18. Furthermore, the blower 16 is arranged between the film drive 7 and the cutter 18. In the feed direction D downstream of or below the cutter 18, preferably and in the illustrated embodiment, there is a welder 19 with two weld bars 20 and 21. Moreover, advantageously, in the feed direction D downstream of or below the film-feed head 5, there is an opener 22 with suction jaws 23 and 24. The opener 22 serves to open the initially closed tubular film 2 for a subsequent draw-down process.

We claim:

1. An apparatus for wrapping an object with a film, the apparatus comprising:

a pair of generally planar guide plates having flat inner faces converging downstream in a feed direction and defining a gap and flat outer faces turned away from each other;

drive means for pulling the film from a supply and feeding it in the feed direction through the gap toward an object to be wrapped with the film;

pull-down means downstream in the direction from the plates for drawing the film around the object; and blower means for directing respective streams of air under pressure in the feed direction along each of the outer faces so as to entrain the film in the feed direction.

2. The wrapping apparatus defined in claim 1 wherein the film is a closed tubular film and the pull-down means spreads the film before drawing it down over the object.

3. The wrapping apparatus defined in claim 1 wherein the drive means includes:

a guide roller;

at least one pair of counter rollers movable against the guide roller to pinch the film thereagainst; and means for rotating one of the rollers.

4. The wrapping apparatus defined in claim 3 wherein the means for rotating is connected to the guide roller.

5. The wrapping apparatus defined in claim 1 wherein the plates have a width equal to at least 80% of a width of the film at the gap.

6. The wrapping apparatus defined in claim 5 wherein the plates have a width greater than the width of the film at the gap.

7. The wrapping apparatus defined in claim 1 wherein the inner faces form an angle of between 20° and 45°.

8. The wrapping apparatus defined in claim 1 wherein each of the streams of air has a dimension parallel to a width of the film equal to at least 80% of the width of the film.

9. The wrapping apparatus defined in claim 1 wherein each of the streams of air has a dimension parallel to a width of the film greater than the width of the film.

10. The wrapping apparatus defined in claim 1 wherein the blower means includes respective blow pipes extending parallel to the outer faces and generally perpendicular to the direction and each having a plurality of spaced blow holes directed parallel to the respective outer face.

11. The wrapping apparatus defined in claim 1 wherein the streams move in laminar flow over the respective outer faces and then in laminar flow along the film in the direction.

12. The wrapping apparatus defined in claim 1 wherein the drive means is upstream of the gap.

13. The wrapping apparatus defined in claim 1, further comprising means for longitudinally subdividing the film into separate sections.

14. The wrapping apparatus defined in claim 13 wherein the subdividing means is downstream of the plates.

15. The wrapping apparatus defined in claim 1, further comprising means for welding the film downstream of the plates.

16. An apparatus for wrapping an object with a film, the apparatus comprising:

a pair of generally planar guide plates having flat inner faces converging downstream in a feed direction and defining a gap and flat outer faces turned away from each other;

drive means for pulling the film from a supply and feeding it in the feed direction through the gap toward an object to be wrapped with the film;

pull-down means downstream in the direction from the plates for drawing the film around the object; and blower means for directing a stream of air under pressure in the feed direction along one of the outer faces so as to entrain the film in the feed direction.

* * * * *